US010211540B2

(12) United States Patent
Roitberg et al.

(10) Patent No.: US 10,211,540 B2
(45) Date of Patent: Feb. 19, 2019

(54) METHODS CIRCUITS DEVICES ASSEMBLIES AND SYSTEMS FOR WIRELESS COMMUNICATION

(71) Applicant: GetSat Communications Ltd., Rehovot (IL)

(72) Inventors: Oleg Roitberg, Rehovot (IL); Kfir Benjamin, Rehovot (IL); Luca Marcaccioli, Perugia (IT); Simone Montori, Perugia (IT); Roberto Sorrentino, Perugia (IT)

(73) Assignee: GetSat Communications Ltd., Rehovot (IL)

( * ) Notice: Subject to any disclaimer, the term of this patent is extended or adjusted under 35 U.S.C. 154(b) by 220 days.

(21) Appl. No.: 15/059,483

(22) Filed: Mar. 3, 2016

(65) Prior Publication Data

US 2017/0025737 A1 Jan. 26, 2017

Related U.S. Application Data

(60) Provisional application No. 62/159,391, filed on May 11, 2015.

(51) Int. Cl.

| | |
|---|---|
| ***H01Q 21/00*** | (2006.01) |
| ***H01Q 21/24*** | (2006.01) |
| ***H01Q 21/06*** | (2006.01) |

(52) U.S. Cl.

CPC ..... *H01Q 21/0075* (2013.01); *H01Q 21/065* (2013.01); *H01Q 21/24* (2013.01)

(58) Field of Classification Search

CPC ..... H01Q 21/0075; H01Q 21/0081

See application file for complete search history.

(56) References Cited

U.S. PATENT DOCUMENTS

2016/0218438 A1* 7/2016 Miraftab ..... H01Q 21/0075

* cited by examiner

*Primary Examiner* — Robert Karacsony

(74) *Attorney, Agent, or Firm* — Vladimir Sherman; Professional Patent Solutions Ltd.

(57) ABSTRACT

Disclosed herein are methods, circuits, devices, assemblies and systems for facilitating wireless communication, both satellite and terrestrial. According to embodiments, there may be provided a composite antenna structure including multiple antenna element clusters, wherein each antenna cluster may be comprised of a set of antenna elements disposed in proximity to one another and connected to one another through an intra-cluster signal distribution line. Antenna element clusters may be connected to one another and to a main signal line through a network of inter-cluster signal distribution lines. A first set of antenna element clusters may be connected to a transmission signal (TX) line, thereby forming a TX antenna. A second set of antenna element clusters may be connected to a receive signal (RX) line, thereby forming a second RX antenna. Antenna elements of RX and TX antenna element clusters may disposed on a common surface, or parallel surfaces, in an interlaced manner.

7 Claims, 8 Drawing Sheets

METHODS CIRCUITS DEVICES ASSEMBLIES AND SYSTEMS FOR WIRELESS COMMUNICATION

RELATED APPLICATIONS

The present application claims priority from U.S. Provisional Patent Application Ser. No. 62/159,391, filed on May 11, 2015 and entitled "Methods Circuits Devices Assemblies and Systems for Wireless Communication". The '391 application is hereby incorporated by reference in its entirety.

FIELD OF THE INVENTION

The present invention generally relates to the field of wireless communication. More specifically, the present invention relates to methods, circuits, devices, assemblies and systems for facilitating wireless communication, both satellite and terrestrial.

BACKGROUND

An antenna (plural antennae or antennas), or aerial, is an electrical device which converts electric power into electromagnetic energy such as radio waves, and vice versa. It is usually used with a radio transmitter and/or a radio receiver to communicate information between points not connected by an electrical conductor. In transmission, a radio transmitter supplies an electric current oscillating at radio frequency (i.e. a high frequency alternating current (AC)) to the antenna's terminals, and the antenna radiates the energy from the current as electromagnetic waves (radio waves). In reception, an antenna intercepts some of the power of an electromagnetic wave in order to produce a tiny voltage at its terminals that is applied to an amplifier of a receiver.

Typically an antenna consists of an arrangement of metallic conductors (elements), electrically connected (often through a transmission line) to the receiver or transmitter. An oscillating current of electrons forced through the antenna by a transmitter will create an oscillating magnetic field around the antenna elements, while the charge of the electrons also creates an oscillating electric field along the elements. These time-varying fields radiate away from the antenna into space as a moving transverse electromagnetic field wave. Conversely, during reception, the oscillating electric and magnetic fields of an incoming radio wave exert force on the electrons in the antenna elements, causing them to move back and forth, creating oscillating currents in the antenna.

Antennas can be designed to transmit and receive radio waves in all horizontal directions equally (omnidirectional antennas), or preferentially in a particular direction (directional or high gain antennas). In the latter case, an antenna may also include additional elements or surfaces with no electrical connection to the transmitter or receiver, such as parasitic elements, parabolic reflectors or horns, which serve to direct the radio waves into a beam or other desired radiation pattern. FIG. 2A shows a set of directional antenna designs utilizing one or more RF reflectors in order to concentrate RF radiation arriving from a specific direction onto an opening of an RF receiver.

Antennas are essential components of all wireless communication equipment, receivers and transmitters, used as part of systems for radio broadcasting, broadcast television, two-way radio, communications receivers, radar, cell phones, and satellite communications, as well as other devices such as garage door openers, wireless microphones, Bluetooth-enabled devices, wireless computer networks, baby monitors, and RFID tags on merchandise.

Wi-Fi is a wireless local area network that enables portable computing devices to connect easily to the Internet. Standardized as IEEE 802.11 a,b,g,n, Wi-Fi approaches speeds of some types of wired Ethernet. Wi-Fi has become the de facto standard for access in private homes, within offices, and at public hotspots.

Cellular data service offers coverage within a range of 10-15 miles from the nearest cell site. Speeds have increased as technologies have evolved, from earlier technologies such as GSM, CDMA and GPRS, to 3G networks such as W-CDMA, EDGE, CDMA2000, UMTS, HSDPA, LTE, etc. Mobile Satellite Communications may be used where other wireless connections are unavailable, such as in largely rural areas or remote locations. FIG. 1A shows two ground stations communicating though a satellite relay. FIG. 1B shows a satellite acting as a signal relay between multiple terrestrial ground-stations geographically dispersed across the United States.

Satellite communications are especially important for transportation, aviation, maritime and military use. A very small aperture terminal (VSAT) is a two-way satellite ground station or a stabilized maritime VSAT antenna with an antenna that is smaller than 3 meters. The majority of VSAT antennas range from 75 cm to 1.2 m. Data rates range from 4 kbit/s up to 4 Mbit/s and higher. New modulation technologies are pushing the limits of uplink and downlink speeds. VSATs usually access satellites in geosynchronous orbits. VSATs can be used to transmit narrowband data (e.g., point-of-sale transactions using credit cards, polling or RFID data, or SCADA), or broadband data (for the provision of satellite Internet access to remote locations, VoIP or video). VSATs are also used for transportable, on-the-move or mobile maritime communications. The antenna designs from FIG. 2A may be used as VSATs.

FIG. 2B includes a set of antenna array designs, which antenna arrays may also provide either fixed or steerable directivity for both reception and transmission of RF. As evident from the designs, antenna arrays can be quite large, depending upon the number and relative placement of the antenna array elements. Typically, the larger the placement between antennas or antenna elements of an array the better directivity is achievable. There is, however, a need in the field of wireless communication for improved directivity with smaller form factors.

As demand for wireless communication systems having higher data rates at lower power consumption levels and using smaller form factors increases, there is likewise an increased need in the field of wireless communication for improved antennas and antenna assemblies with capacity to provide high TX and RX directivity.

SUMMARY OF INVENTION

The present invention includes methods, circuits, assemblies, devices, systems and associated computer executable code for wireless communication. According to embodiments, there may be provided an antenna array comprised of a set of individual antenna elements used for transmitting and/or receiving electromagnetic signals, such as radio waves (RF). Antenna elements of an antenna according to embodiments may be electrically interconnected according to an arrangement or pattern which induces electrical current flow distribution through respective antenna elements according to an amplitude and/or phase relationship which causes the array of antenna elements to act as a single antenna with directional characteristics, such that the antenna has relatively higher transmission or reception gain in a specific direction than in other directions. An antenna element array according to embodiments may be arranged and/or configured to use electromagnetic wave interference to enhance a radiative signal in a desired direction at the expense of other directions. The antenna element array may also be configured to null a radiation pattern in one particular direction. A collective directionality of the antenna element array obtained through the arrangement may be greater than that provided by any individual antenna element, and thus a higher antenna gain may be provided, both for reception and transmission of RF signals.

According to embodiments, there may be provided an antenna assembly including two or more separate antenna element arrays, for example, a first array for receiving electromagnetic signals and another (e.g. second) array for transmitting electromagnetic signals. According to some embodiments, some elements of either or both of the two or more separate antenna element arrays may be disposed across the same plane of the assembly, while other elements of either or both of the two or more separate antenna arrays may be disposed across different planes of the assembly. According to embodiments, some antenna array elements, such as signal distribution lines (for a TX Antenna Array) and/or signal aggregation lines (for an RX Antenna Array) may be disposed across separate planes of the antenna assembly. An assembly of antenna elements forming an array of antenna elements and/or a combination of antenna element arrays may be referred to and treated as "an antenna" or as an "integrated composite antenna" (ICA).

According to embodiments, there may be provided an integrated composite antenna (ICA) structure composed at least partially of one or more antenna element clusters of a first type. An antenna element cluster of the first type may be comprised of a set of antenna elements of a first type and placed in proximity to one another on the same plane. Antenna elements of the first type may be radiating antenna elements, and radiating antenna elements within the same cluster may be connected to one another through an intra-cluster signal line. Each antenna element cluster may include a dedicated intra-cluster signal line with multiple nodes, some for connecting to antenna elements and one for electrically connecting, directly or indirectly, to a transmission signal line. Accordingly, an antenna element cluster of the first type may be referred to as a transmission (TX) antenna element cluster, a transmission type antenna element cluster, or an antenna element cluster of a transmission type. A transmission type antenna cluster according to embodiments may be electrically connected, directly or indirectly, to a transmission signal output line of an RF transmitter or an RF transceiver, and may thus form a (TX) antenna or directional TX antenna array.

A TX antenna array according to further embodiments may include two or more transmission type antenna element clusters, each with its own intra-cluster signal line, connected to one another through an electrical signal path including one or more inter-cluster signal lines. Intra-cluster signal lines of the TX antenna array may be referred to as intra-cluster signal distribution lines, while inter-cluster signal lines of the TX antenna array may be referred to as inter-cluster signal distribution lines. Thus, radiating antenna elements of the transmission antenna element cluster type may be connected to a transmission signal (TX) line of the ICA through a signal path including an intra-cluster signal distribution line and an inter-cluster signal distribution line. According to further embodiments, the antenna elements, the intra-cluster signal lines and the inter-cluster signal lines may all be located on different planes and selectively interconnected by trans-planer electrical interconnect elements.

According to further embodiments, trans-planer interconnect elements (interconnects) may be part of the TX signal distribution path from the TX signal line to the individual radiating TX antenna elements. For example, a trans-planner interconnect may be used to connect each of one or more points on an inter-cluster signal distribution line to a respective intra-cluster signal distribution line residing on a different plane of the ICA. Likewise, a trans-planer interconnect may also be used to connect each of one or more points on an intra-cluster signal distribution line to a respective radiating element residing on a different plane of an ICA according to embodiments.

According to further embodiments, the ICA may include one or more antenna element clusters of a second type, each cluster composed of two or more receive, receiver or receiving antenna elements (all three usable interchangeably). A receiver antenna element of a cluster may be disposed on the same of parallel plane as a radiating element of corresponding cluster of the first type. According to further embodiments, receiving antenna elements of a cluster of the second type may be disposed in an interlaced manner with radiating antenna elements of a corresponding cluster of the first type, such that a receiving antenna element of the ICA may be located in-between radiating elements, and visa-versa. An antenna element cluster of radiating elements interlaced with an antenna element cluster of receiving elements may be referred to as a Bidirectional Antenna Element Cluster (BAEC). An ICA according to embodiments may include one DAEC or a set of BAEC's spaced at some distance from one another.

Receiver antenna elements of an antenna element cluster of the second type, according to embodiments, may be electrically interconnected to one another through an intra-cluster signal line, which intra-cluster signal line may be referred to as an intra-cluster signal aggregation line. Each antenna element cluster of receiving elements may include a dedicated intra-cluster signal aggregation line with multiple nodes, some for connecting to receiving antenna elements and one for electrically connecting, directly or indirectly, to a receive (RX) signal line. Accordingly, an antenna element cluster of the second type may be referred to as a receiver or receive (RX) antenna element cluster, a receiver type antenna element cluster, or an antenna element cluster of a receiving type. A receiving type antenna cluster according to embodiments may be electrically connected, directly or indirectly, to a receiver signal input line of an RF receiver or an RF transceiver, and may thus form an (RX) antenna or directional RX antenna array.

An RX antenna array according to further embodiments may include two or more receiving type antenna element clusters, each with its own intra-cluster signal line, connected to one another through an electrical signal path including one or more inter-cluster signal lines. Intra-cluster signal lines of the RX antenna array may be referred to as intra-cluster signal aggregation lines, while inter-cluster signal lines of the RX antenna array may be referred to as inter-cluster signal aggregation lines. Thus, receiving antenna elements of the receiver antenna element cluster may be connected to a receiver signal (RX) line of the ICA through a signal path including an intra-cluster signal aggregation line and an inter-cluster signal aggregation line. According to further embodiments, the antenna elements, the intra-cluster signal lines and the inter-cluster signal lines may all be located on different planes and selectively interconnected by trans-planer electrical interconnect elements.

According to further embodiments, trans-planer interconnect elements (interconnects) may be part of the RX signal aggregation path from the individual receiving RX antenna elements to the RX signal line leading to a receiver input. For example, a trans-planer interconnect may be used to connect each of one or more points on an inter-cluster signal aggregation line to a respective intra-cluster signal aggregation line residing on a different plane of the ICA. Likewise, a trans-planer interconnect may also be used to connect each of one or more points on an intra-cluster signal aggregation line to a respective receiving antenna element residing on a different plane of an ICA according to embodiments.

According to further embodiments, a second set of antenna element clusters may be disposed on either the first or on another plane of the multi-layer PCB. The second set of antenna element clusters may be formed and interconnected to one another similarly to the first set of antenna element clusters, thereby forming a second antenna array on the same PCB as the first array. One of the antenna arrays, for example the first antenna array, may be configured as a beam-forming RF transmission antenna array. While the other antenna array disposed on the same PCB, for example the second antenna array, may be configured as a beam-forming RF receiver/receiving antenna array. Collectively, the two antenna element arrays disposed on the same PCB form a bi-directional beam-forming RF antenna usable with RF transmitters, receivers and/or transceivers including those used in conjunction with terrestrial and satellite communication systems.

According to embodiments, the first and second sets of antenna element clusters may each form a waveguide beam-forming network. The first beam-forming network may be configured for operation at TX frequencies, such that it divides a signal from one source, such as the output of an RF transmitter, to a given number (e.g. 128) of transmitting areas or elements. The second beam-forming network may be configured for operation at RX frequencies, such that it aggregates or combines signals from a given number (e.g. 128) of receiving areas or elements to the antenna output connected to an RF receiver input. Each of the transmitting areas may include one or a cluster of multiple antenna elements, and likewise each receiving area may include one or a cluster of multiple antenna elements.

According to embodiments, TX antenna clusters may be comprised of relatively smaller antenna elements than are RX antenna clusters. According to further embodiments, the PCB may include at least one ground plane corresponding to the antenna element clusters. A ground plane may correspond to the TX antenna element clusters. A ground plane may correspond to the RX antenna element clusters. According to further embodiments, the PCB may include two separate ground planes, one of the TX elements clusters and the other for the RX element clusters.

According to some embodiments, one of the antenna arrays may be connected to a transmission line of an RF transmitter or transceiver, while the second antenna array may be connected to a receive line of an RF receiver or transceiver. A composite antenna according to embodiments may be mounted on an electromechanical turret or similar aiming platform. The electromechanical turret may be connected to a controller by a controller or control system adapted to target or track a direction of a satellite or terrestrial wireless access point (e.g. base-station). The antenna, turret, turret control system and functionally associated transceiver may be carrier on a moving platform such as a vehicle, vessel or aircraft.

BRIEF DESCRIPTION OF THE FIGURES

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

Figure 1A:
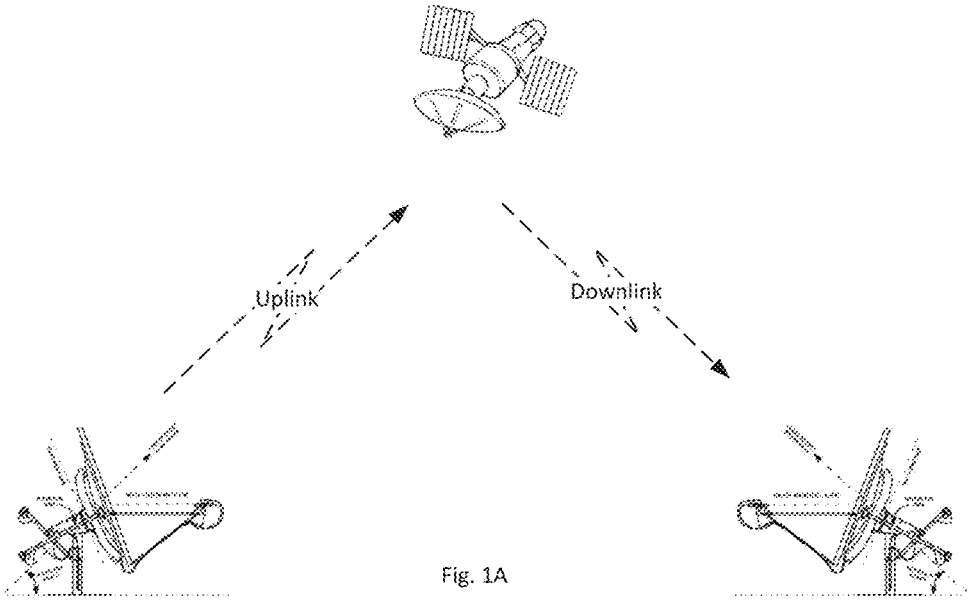
FIG. 1A illustrates a point to point wireless communication link between two communication nodes facilitated by a satellite acting as a signal relay.
Figure 1B:
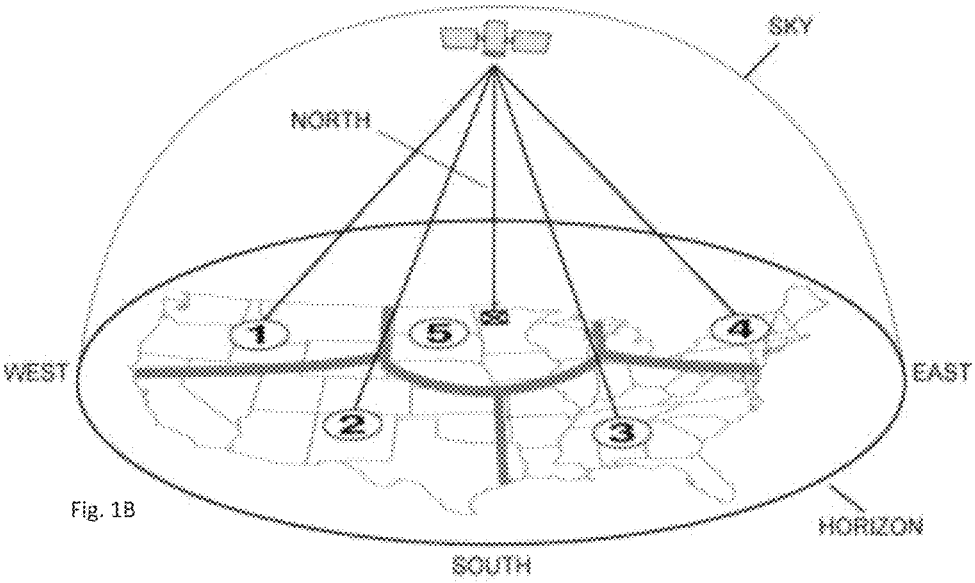
FIG. 1B illustrates a satellite communication system or network including a single satellite providing wireless connectivity and date relay service between a set of terrestrial communication nodes spread across the United States.
Figure 2A:
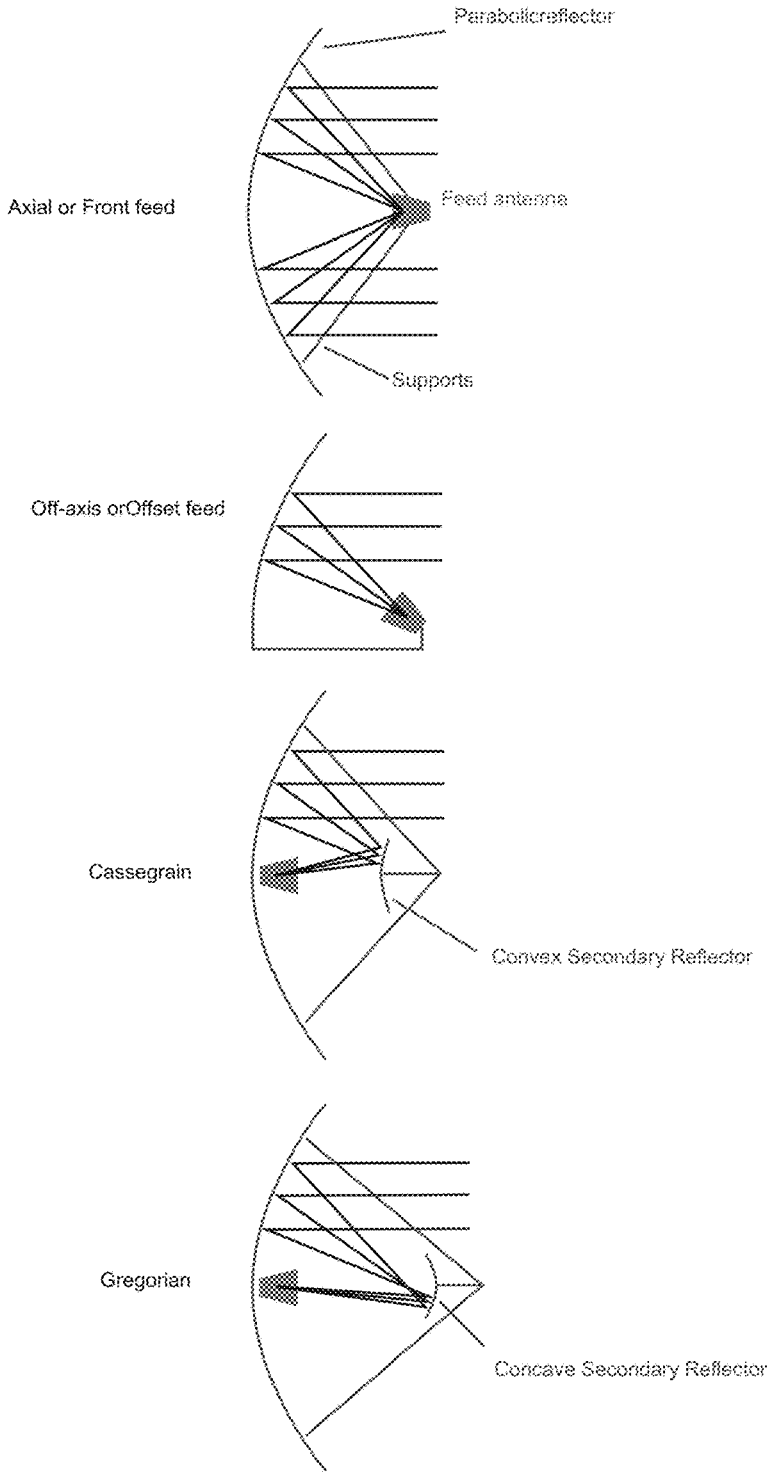
FIG. 2A includes illustrations of a set of antenna designs using signal reflectors to provide directional antennas usable in conjunction with wireless RF communication systems.
Figure 2B:
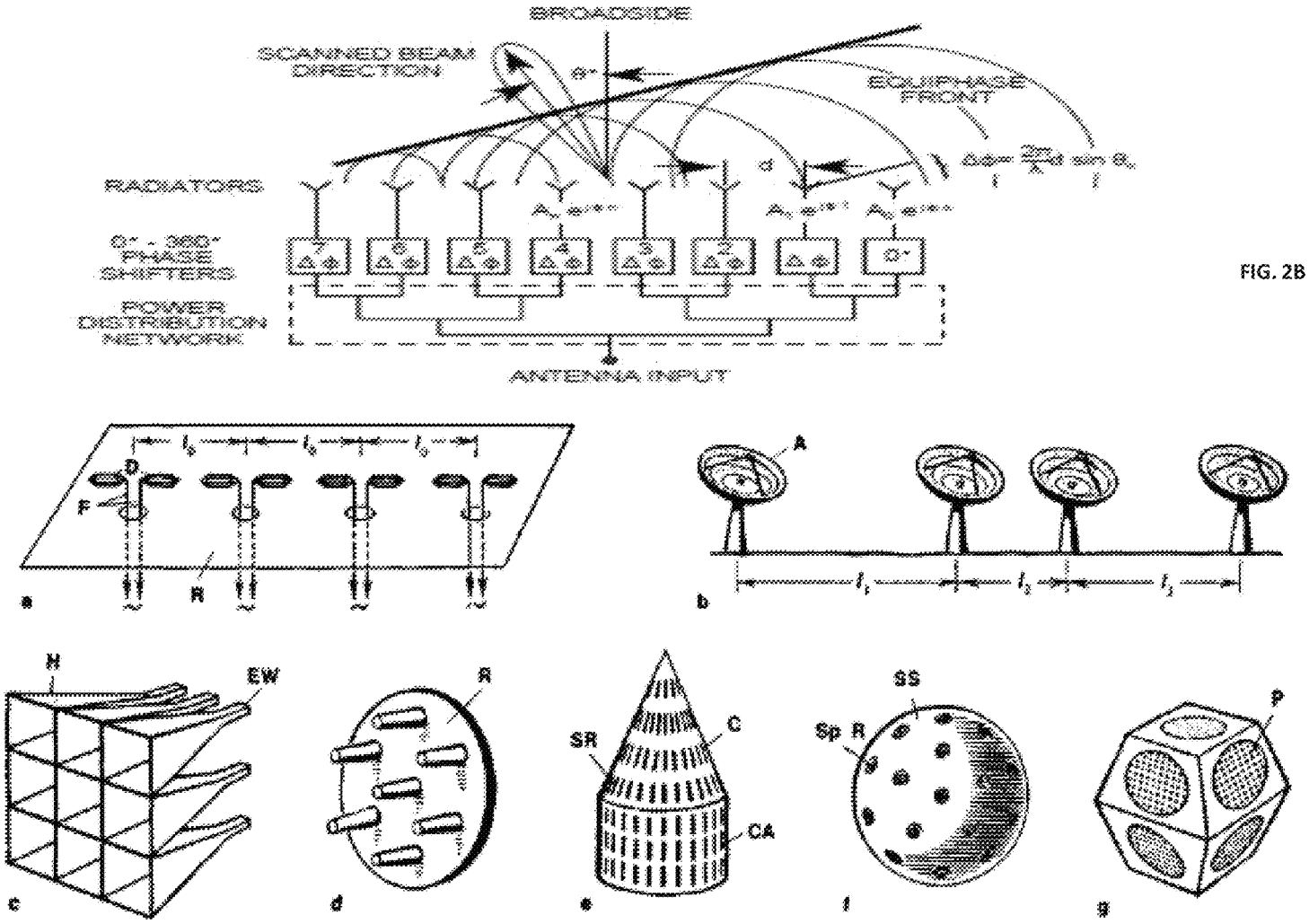
FIG. 2B includes illustrations of a set of antenna designs for antenna arrays (e.g. phased arrays) usable in conjunction with wireless RF communication systems.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION OF THE FIGURES

In the following detailed description, numerous specific details are set forth in order to provide a thorough understanding of the invention. However, it will be understood by those skilled in the art that the present invention may be practiced without these specific details. In other instances, well-known methods, procedures, components and circuits have not been described in detail so as not to obscure the present invention.

Unless specifically stated otherwise, as apparent from the following discussions, it is appreciated that throughout the specification discussions utilizing terms such as "processing", "computing", "calculating", "determining", or the like, may refer to the action and/or processes of a computer or computing system, or similar electronic computing device, that manipulate and/or transform data represented as physical, such as electronic, quantities within the computing system's registers and/or memories into other data similarly represented as physical quantities within the computing system's memories, registers or other such information storage, transmission or display devices.

In addition, throughout the specification discussions utilizing terms such as "storing", "hosting", "caching", "saving", or the like, may refer to the action and/or processes of 'writing' and 'keeping' digital information on a computer or computing system, or similar electronic computing device, and may be interchangeably used. The term "plurality" may be used throughout the specification to describe two or more components, devices, elements, parameters and the like.

Some embodiments of the invention, for example, may take the form of an entirely hardware embodiment, an entirely software embodiment, or an embodiment including both hardware and software elements. Some embodiments may be implemented in software, which includes but is not limited to firmware, resident software, microcode, or the like. Furthermore, some embodiments of the invention may take the form of a computer program product accessible from a computer-usable or computer-readable medium providing program code for use by or in connection with a computer or any instruction execution system. For example, a computer-usable or computer-readable medium may be or may include any apparatus that can contain, store, communicate, propagate, or transport the program for use by or in connection with the instruction execution system, apparatus, or device.

In some embodiments, the medium may be an electronic, magnetic, optical, electromagnetic, infrared, or semiconductor system (or apparatus or device) or a propagation medium. Some demonstrative examples of a computer-readable medium may include a semiconductor or solid state memory, magnetic tape, a removable computer diskette, a random access memory (RAM), a read-only memory (ROM), any composition and/or architecture of semiconductor based Non-Volatile Memory (NVM), any composition and/or architecture of biologically based Non-Volatile Memory (NVM), a rigid magnetic disk, and an optical disk. Some demonstrative examples of optical disks include compact disk-read only memory (CD-ROM), compact disk-read/write (CD-R/W), and DVD.

In some embodiments, a data processing system suitable for storing and/or executing program code may include at least one processor coupled directly or indirectly to memory elements, for example, through a system bus. The memory elements may include, for example, local memory employed during actual execution of the program code, bulk storage, and cache memories which may provide temporary storage of at least some program code in order to reduce the number of times code must be retrieved from bulk storage during execution.

In some embodiments, input/output or I/O devices (including but not limited to keyboards, displays, pointing devices, etc.) may be coupled to the system either directly or through intervening I/O controllers. In some embodiments, network adapters may be coupled to the system to enable the data processing system to become coupled to other data processing systems or remote printers or storage devices, for example, through intervening private or public networks. In some embodiments, modems, cable modems and Ethernet cards are demonstrative examples of types of network adapters. Other functionally suitable components may be used.

According to embodiments, there may be provided an integrated composite antenna (ICA) including a first antenna element array comprising two or more antenna element clusters of a first type and disposed on a first plane, wherein each cluster may be comprised of two or more radiating antenna elements electrically connected to one another with an intra-cluster signal line and the two or more antenna element clusters of the first type are electrically connected to one another through an inter-cluster signal line. The ICA may include a transmission (TX) signal line disposed on a second plane and electrically connected to the inter-cluster signal line with a trans-planer interconnect, optionally passing through a ground plane. The ICA may include a second antenna element array comprising at least one antenna element cluster of a second type including receiving antenna elements disposed in an interlaced manner with radiating antenna elements of at least one of said antenna element clusters of the first type. The intra-cluster signal line may be a signal distribution line disposed on a plane other than the first plane and connected to each of two or more antenna elements with a trans-planer interconnect. The ICA may include an intra-cluster signal aggregation line electrically connecting two or more receiving antenna elements of the antenna element cluster of the second type to one another. The intra-cluster signal aggregation line is disposed on a plane different from a plane upon which said receiving antenna elements are disposed and is connected to respective receiving antenna elements through a trans-planer interconnect. The intra-cluster signal aggregation line may electrically connect receiving antenna elements of a cluster of the second type to a Receive (RX) signal line through a signal path which includes a trans-planner interconnect. Two or more receiving antenna elements of two or more clusters of the second type may be electrically connected to one another and to the RX signal line through an inter-cluster signal aggregation line residing on a plane other than the antenna element or intra-cluster planes. One or more of the antenna element clusters of the first type may include: (a) two or more antenna elements configured for operation in the KA/K band; and (b) polarizers. The polarizers may be integrated and may provide for circular polarization (LHCP/RHCP) on the antenna element clusters of the first type. One or more of the antenna element clusters of the second type may include: (a) two or more antenna elements configured for operation in the KA/K band; and (b) polarizers. The polarizers may be integrated and may provide for circular polarization (LHCP/RHCP) on the antenna element clusters of the second type.

According to embodiments, there may be provided a wireless communication system comprising a wireless transceiver and a composite antenna structure including at least one antenna element cluster of a first type having a set of radiating antenna elements disposed on a first plane and interconnected by an intra-cluster signal distribution line. The antenna structure may include at least one antenna element cluster of a second type including a set of receiving antenna elements interconnected by an intra-cluster signal aggregation line and disposed, either on the first plane or on a plane parallel to the first plane, in an interlaced manner with the radiating antenna elements.

The composite antenna structure may include an inter-cluster signal distribution line interconnecting two or more antenna element clusters of said first type. The radiating antennal elements and the intra-cluster signal distributions lines may be disposed on different planes and electrically interconnected through one or more trans-planer interconnects. The intra-cluster signal distribution lines and the inter-cluster signal distribution lines may each be disposed on a different plane and interconnected through one or more trans-planer interconnects. The intra-cluster signal distribution lines may be composed of a strip-line and the inter-cluster signal distribution lines may be formed by a cavity waveguide. A transmission signal line of the composite antenna structure may be connectable or connected to an output of the RF transceiver.

The composite antenna structure according to embodiments may further include an inter-cluster signal aggregation line interconnecting two or more antenna element clusters of said second type. The receiving antennal elements and the intra-cluster signal aggregation lines may be disposed on different planes and electrically interconnected through one or more trans-planer interconnects. The intra-cluster signal aggregation lines and the inter-cluster signal aggregation lines may each be disposed on a different plane and interconnected through one or more trans-planer interconnects. The intra-cluster signal aggregation lines may be composed of a strip-line and the inter-cluster signal aggregation lines may be formed by a cavity waveguide. A receive signal line of the antenna structure may be connected to an input of the RF transceiver.

Figure 3A:
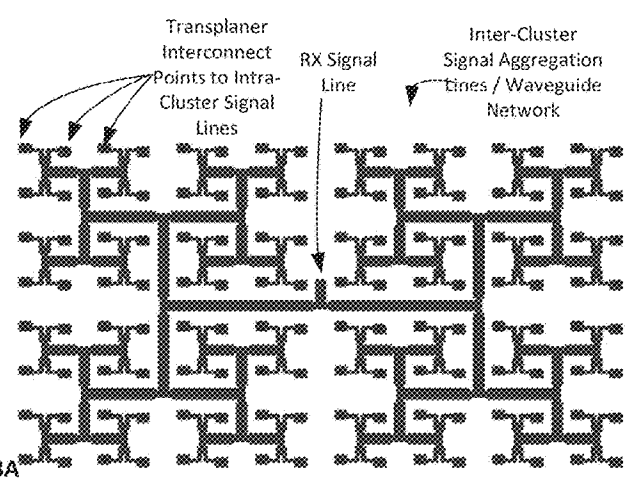
FIG. 3A shows a top view of a waveguide signal aggregation network of an exemplary receive (RX) antenna composed of an array of RX antenna elements electrically interconnected with one another according to an embodiment of the present invention.
Figure 3B:
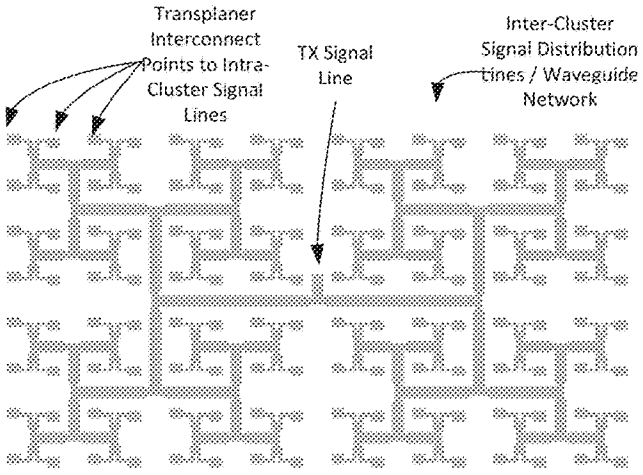
FIG. 3B shows a top view of a waveguide signal distribution network of an exemplary transmit (TX) antenna composed of an array of TX antenna elements electrically interconnected with one another according to an embodiment of the present invention.
Figure 3C:
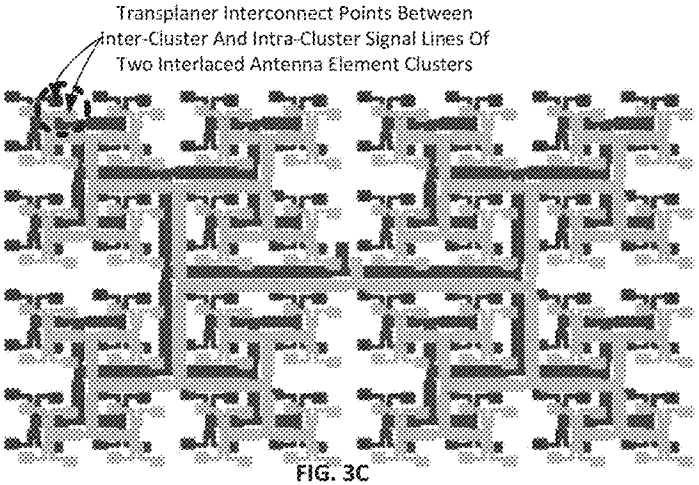
FIG. 3C shows a top view of two waveguide networks of an exemplary bidirectional antenna composed of an RX antenna according to embodiments of the present invention interwoven, interlaced, overlaid or otherwise combined in an isolated manner with a TX antenna according to embodiments of the present invention.

Turning now to FIG. 3A, there is shown a top view of a waveguide signal aggregation network of an exemplary receive (RX) antenna composed of an array of RX antenna elements electrically interconnected with one another according to an embodiment of the present invention. The signal aggregation network corresponds to inter-cluster signal lines described herein, and the end nodes correspond to transplaner interconnect points between inter-cluster and intra-cluster signal lines. FIG. 3B shows a top view of a waveguide signal distribution network of an exemplary transmit (TX) antenna composed of an array of TX antenna elements electrically interconnected with one another according to an embodiment of the present invention. The signal aggregation network corresponds to inter-cluster signal lines described herein, and the end nodes correspond to transplaner interconnect points between inter-cluster and intra-cluster signal lines. FIG. 3C shows a top view of the RT and TX waveguide networks overlaid on one another in an isolated manner to form an exemplary bidirectional antenna composed of an RX antenna according to embodiments of the present invention interwoven, interlaced, overlaid or otherwise combined with a TX antenna according to embodiments of the present invention. Adjacent transplaner interconnect contact points from two separate waveguide networks, as circled in FIG. 3C, lead to intra-cluster signal lines of two interlaced antenna element cluster, one for an RX cluster and another for a TX cluster.

Figure 4A:
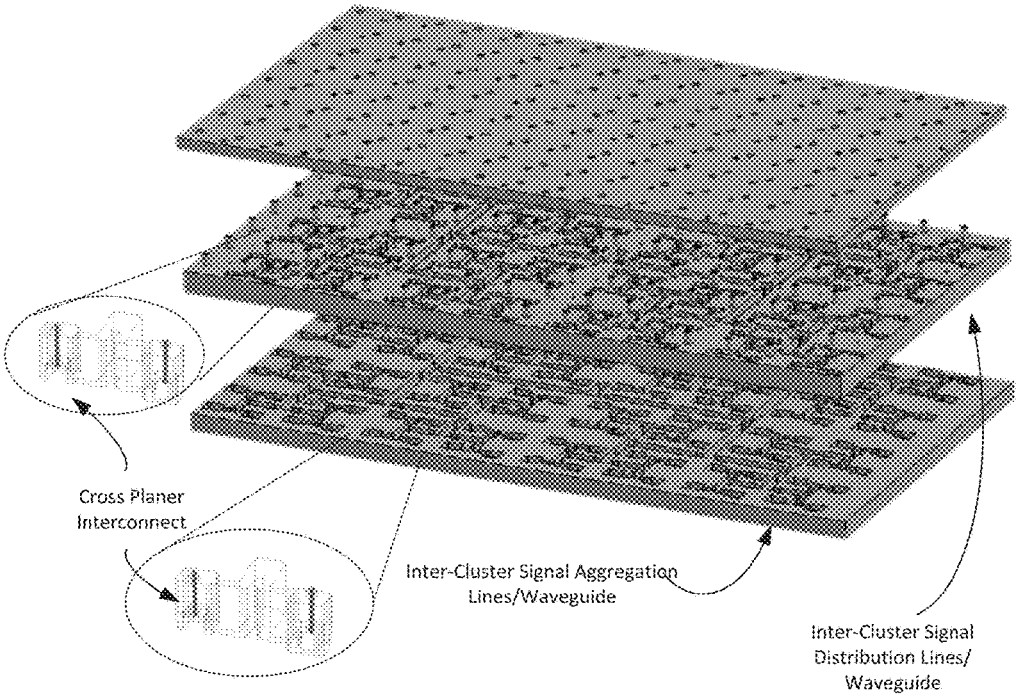
FIG. 4A, there is a prospective exploded view of an exemplary three dimensional (3D) metallic assembly including cavity waveguides within an aluminum casing, wherein the cavity waveguides in each casing corresponds to the inter-cluster signal line/waveguide networks shown in FIGS. 3A and 3B.
Figure 4B:
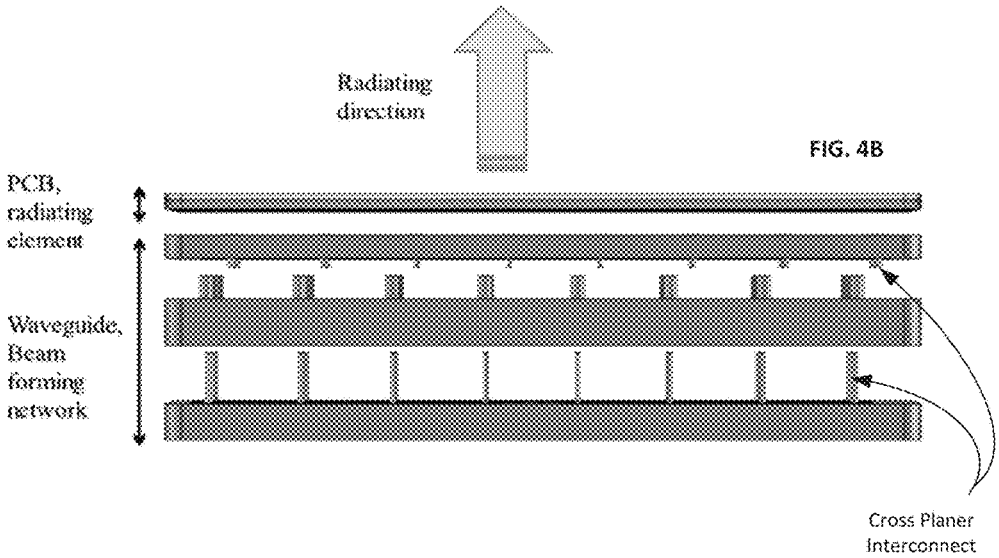
FIG. 4B is side a cross-sectional view of the assembly of FIG. 4A, showing the transplaner interconnects passing from each of the two waveguide layers through a ground plane and towards a PCB upon which the antenna elements according to embodiments of the present invention are disposed.

Turning now to FIG. 4A, there is a prospective exploded view of an exemplary three dimensional (3D) metallic assembly including cavity waveguides within an aluminum casing corresponding to the inter-cluster signal line networks shown in FIGS. 3A and 3B. Also shown in FIG. 4A are zoomed in views of transplaner interconnects passing from each of the two cavity waveguide layers towards an intra-cluster signal line plane, according to embodiments of the present invention. FIG. 4B is a side cross-section view of the assembly of FIG. 4A, showing the transplaner interconnects passing from each of the two waveguide layers through a ground plane and towards a PCB upon which the antenna elements are disposed. Not visible on FIG. 4B are the intra-cluster signal lines interconnected the antenna elements.

Figure 5A:
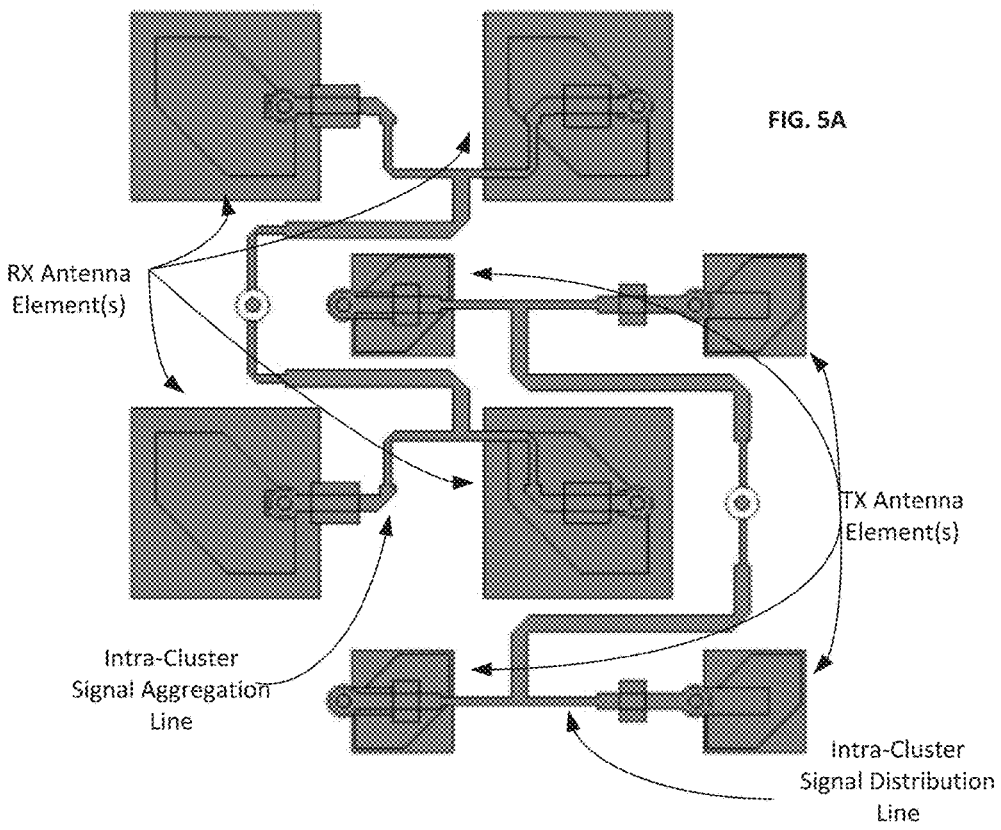
FIG. 5A is a top view of two interlaced antenna elements clusters disposed on a plane of a composite antenna array according to embodiments, wherein one of the clusters is composed of radiating (TX) antenna elements and the other a cluster is composed of receiving (RX) antenna elements.

Turning now to FIG. 5A, there is shown a top view of two antenna element clusters, an RX antenna element cluster and a TX antenna element cluster, disposed on the same or parallel surfaces (Planes) of a PCB in an interlaced manner or pattern. Each of the two interlaced clusters is of a different type and includes its own intra-cluster signal lines/waveguides. The antenna elements of each of the clusters are interconnected to one another through a respective multi-node intra-cluster signal line. These two clusters correspond to the circled interconnect points on FIG. 4A, and each of their respective intra-cluster lines is shown to connect via a transplaner interconnect with a contact point on the inter-cluster signal lines/waveguide, for example, one of the ones shown on FIG. 4A. Each of the intra-cluster multi-node signal lines may be connected to a respective point on a respective inter-cluster signal line/waveguide network with a transplaner interconnect, as understood from FIGS. 4A and 5A together.

Figure 5B:
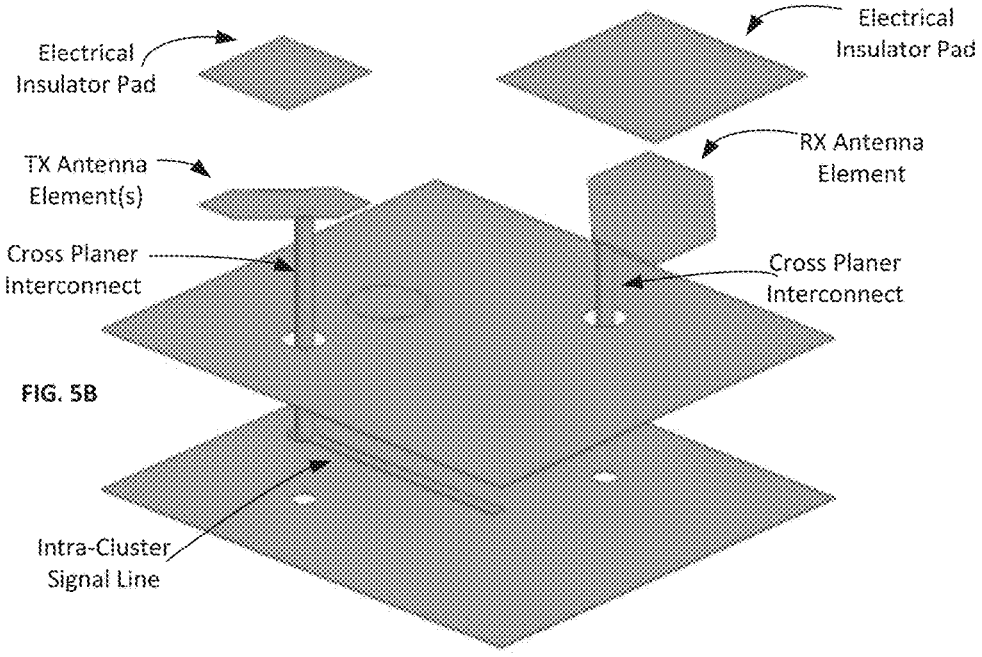
FIG. 5B is an exploded prospective view of a portion, including two antenna elements of different types, from two interlaced antenna clusters according to embodiments of the present invention.

FIG. 5B shows an exploded prospective view of the arrangement of the antenna elements of FIG. 5A relative to each other and to the intra-cluster lines to which the antenna elements are connected. As shown, the antenna elements of each of the clusters are disposed on a plane different from their respective intra-cluster signal lines and are connected thereto with trans-planer interconnects. The antenna elements are separate from their respective intra-cluster signal lines by a ground plane. The antenna elements used for radiating RF are polarized differently than those used for receiving RF. The intra-cluster signal lines may be composed of strip-lines. Also visible from FIGS. 5A and 5B are transplaner interconnects electrically connecting antenna elements, TX and RX antenna elements, to respective intra-cluster signal lines which are deposed on a plane or layer below the plane upon which the antenna elements are deposed.

According to embodiments, signal lines, RX and/or TX, may be composed at least partially of metallic waveguides, metallic cavity waveguides and/or some combination of the two. Intra-cluster signal lines of an RX antenna array may be referred to as intra-cluster signal aggregation lines, while inter-cluster signal lines of the RX antenna array may be referred to as inter-cluster signal aggregation lines. According to embodiments, a first set of antenna elements, forming an antenna element cluster, may be disposed on a first plane of a multi-layer printed circuit board (PCB), while intra-cluster signal lines (also referred to as strip-lines) for electrically connecting the cluster element to each other, to form a cluster, may be disposed on a second plane of the multi-layer printed circuit board (PCB). Trans-planer interconnects may connect each antenna element on the first plane with a respective corresponding point of the intra-cluster signal lines on the second plane in order to form an antenna element cluster. Intra-cluster signal lines of an antenna array according to the present invention may be connected to one another through inter-cluster signal lines located on a third plane. Each intra-cluster signal line(s) may be connected to a respective corresponding point of an inter-cluster signal line, through a transplaner interconnect, thereby forming an antenna array comprised of a set of interconnected antenna element clusters. The inter-cluster signal lines may be connected to either a signal output line of a transmitter or a signal input line of a receiver.

The multilayer PCB stack-up of the antenna portions shown in FIGS. 4B, 5A & 5B may include an upper radiating part and a lower part (ground-plane, strip-line,) used to divide (for the TX path) the signal coming from the waveguide by four and to combine (for the RX path) four received signals into one and send it through the waveguide. Both the TX and RX antennas elements of the antenna may operate according to the same principle: the strip-line may be connected with the lower patch through a via-hole. This patch may be truncated on two opposite corners. Depending on the corners that are truncated, the same antenna can radiate a RHCP or a LHCP. The truncated patch may be coupled to a parasitic square patch printed on the upper substrate. In both the TX and RX antenna elements, the size of the patches and the size of the truncated part are the main parameters used to control the operation of the antenna in terms of Axial Ratio, Input matching, and bandwidth. An antenna according to embodiments may integrate two different arrays (clusters), one working at the lower Ka band RX frequency (18.7 to 21.2 GHz) and the other working at the Ka Band TX frequency (29 to 31 GHz).

Figure 6A:
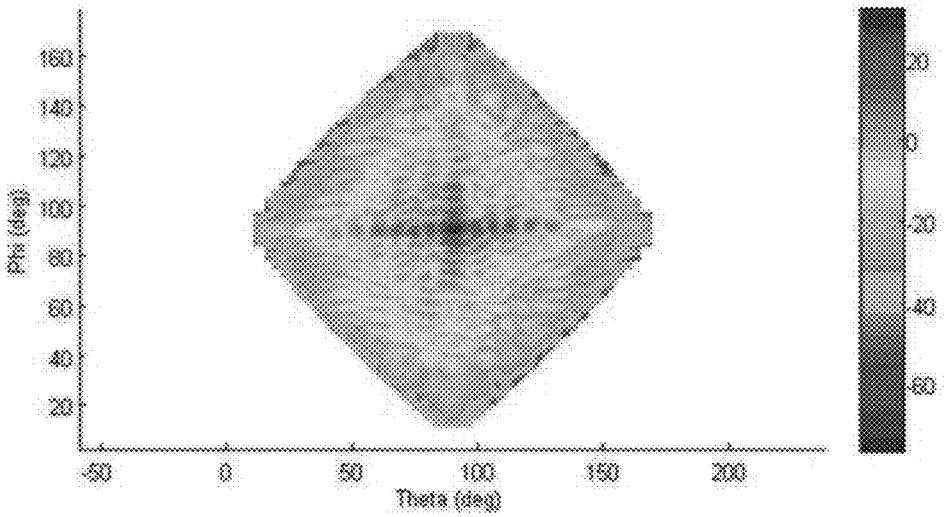
FIGS. 6A & 6B show exemplary measured RX radiation pattern, amplitude and phase respectively, of an RX antenna according to embodiments of the present invention.
Figure 6B:
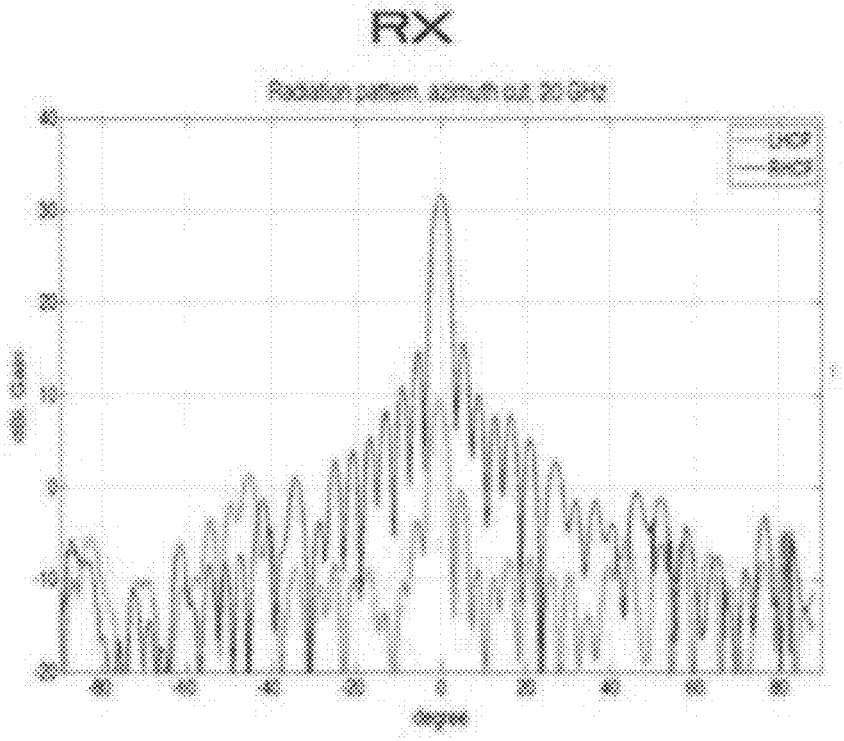

FIGS. 6A & 6B show exemplary measured RX radiation pattern, amplitude and phase respectively, of an RX antenna array according to embodiments of the present invention.

Figure 7A:
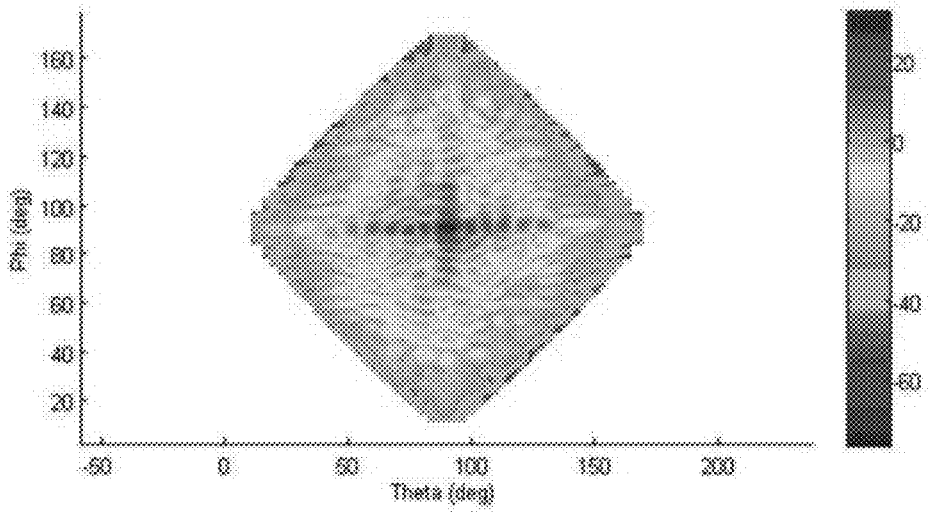
FIGS. 7A & 7B show exemplary measured TX radiation pattern, amplitude and phase respectively, of a TX antenna according to embodiments of the present invention.
Figure 7B:
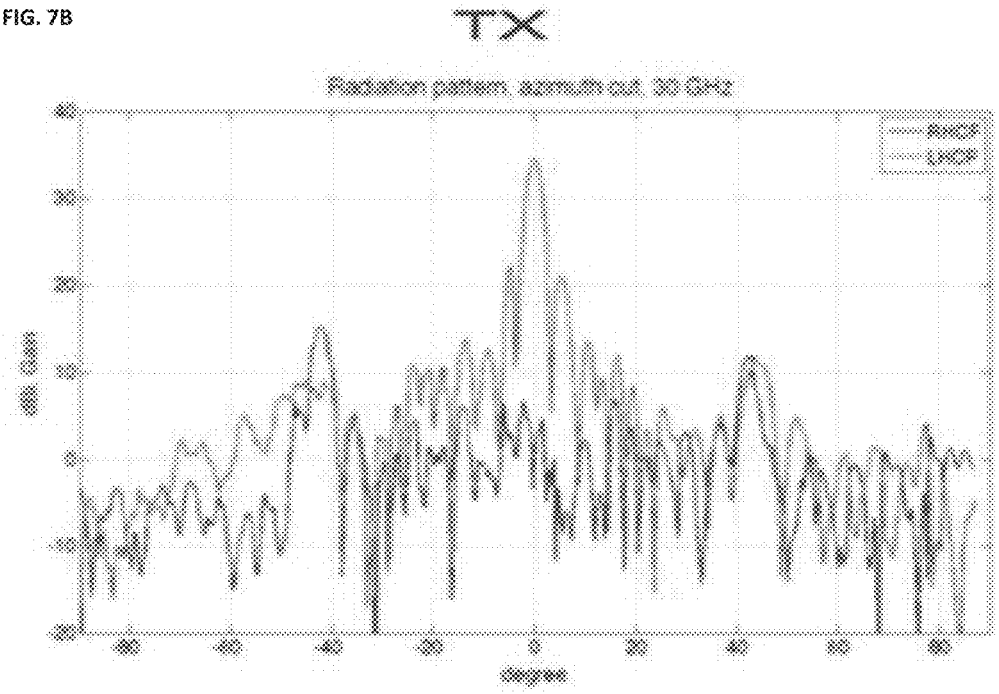

FIGS. 7A & 7B show exemplary measured TX radiation pattern, amplitude and phase respectively, of a TX antenna array according to embodiments of the present invention.

The processes and displays presented herein are not inherently related to any particular computer, device, system or other apparatus. Various general purpose systems may be used with programs in accordance with the teachings herein, or it may prove convenient to construct a more specialized apparatus to perform the desired method. The desired structure for a variety of these systems will appear from the description below. In addition, embodiments of the present invention are not described with reference to any particular programming language. It will be appreciated that a variety of programming languages may be used to implement the teachings of the inventions as described herein.

Functions, operations, components and/or features described herein with reference to one or more embodiments, may be combined or otherwise utilized with one or more other functions, operations, components and/or features described herein with reference to one or more other embodiments, or vice versa. While certain features of the invention have been illustrated and described herein, many modifications, substitutions, changes, and equivalents will now occur to those skilled in the art. It is, therefore, to be understood that the appended claims are intended to cover all such modifications and changes as fall within the true spirit of the invention.

The invention claimed is:

1. An integrated composite antenna (ICA) comprising:

a first antenna element array comprising two or more antenna element clusters of a first type and disposed on a first plane, wherein each cluster is comprised of two or more radiating antenna elements electrically connected to one another with an intra-cluster signal line and the two or more antenna element clusters of the first type are electrically connected to one another through an inter-cluster signal line, wherein said intra-cluster signal line is a signal distribution line disposed on a plane other than the first plane and is connected to each of two or more antenna elements with a trans-planer interconnect;

a transmission (TX) signal line disposed on a second plane and electrically connected to said inter-cluster signal line with a trans-planer interconnect passing through a ground plane;

a second antenna element array comprising at least one antenna element cluster of a second type including receiving antenna elements disposed in an interlaced manner with radiating antenna elements of at least one of said antenna element clusters of the first type; and an intra-cluster signal aggregation line electrically connecting two or more receiving antenna elements of the antenna element cluster of the second type to one another, wherein said intra-cluster signal aggregation line is disposed on a plane different from a plane upon which said receiving antenna elements are disposed and is connected to respective receiving antenna elements through a trans-planer interconnect.

2. The ICA according to claim 1, wherein said intra-cluster signal aggregation line electrically connects receiving antenna elements of a cluster of the second type to an Receive (RX) signal line through a signal path which includes a trans-planner interconnect.

3. The ICA according to claim 2, wherein two or more receiving antenna elements of two or more clusters of the second type are electrically connected to one another and to the RX signal line through an inter-cluster signal aggregation line residing on a plane other than the antenna element or intra-cluster planes.

4. The ICA according to claim 1, wherein one or more of the antenna element clusters of the first type include: (a) two or more antenna elements configured for operation in the KA/K band; and (b) polarizers.

5. The ICA according to claim 4, wherein the polarizers are integrated and provide for circular polarization (LHCP/RHCP).

6. The ICA according to claim 1, wherein one or more of the antenna element clusters of the second type include: (a) two or more antenna elements configured for operation in the KA/K band; and (b) polarizers.

7. The ICA according to claim 6, wherein the polarizers are integrated and provide for circular polarization (LHCP/RHCP).

* * * * *